US006424940B1

(12) United States Patent
Agassy et al.

(10) Patent No.: US 6,424,940 B1
(45) Date of Patent: Jul. 23, 2002

(54) METHOD AND SYSTEM FOR DETERMINING GAIN SCALING COMPENSATION FOR QUANTIZATION

(75) Inventors: Meir Agassy, Givataim; Amir Ilan, Kfar Saba, both of (IL)

(73) Assignee: ECI Telecom Ltd., Petach Tikva (IL)

( * ) Notice: Subject to any disclaimer, the term of this patent is extended or adjusted under 35 U.S.C. 154(b) by 0 days.

(21) Appl. No.: 09/512,386

(22) Filed: Feb. 25, 2000

(30) Foreign Application Priority Data

May 4, 1999 (IL) ..... 129752

(51) Int. Cl.[7] ..... G10L 19/04

(52) U.S. Cl. ..... 704/219; 704/220; 704/221; 704/225

(58) Field of Search ..... 704/219, 220, 704/221, 222, 223, 225

(56) References Cited

U.S. PATENT DOCUMENTS

| | | | | |
|---|---|---|---|---|
| 4,677,423 A | | 6/1987 | Benvenuto et al. | 340/347 |
| 4,969,192 A | | 11/1990 | Chen et al. | 381/31 |
| 5,327,520 A | | 7/1994 | Chen | 395/2.28 |
| 5,381,512 A | * | 1/1995 | Holton et al. | 704/232 |
| 5,675,702 A | | 10/1997 | Gerson et al. | 395/2.32 |
| 5,960,389 A | * | 9/1999 | Jarvinen et al. | 704/220 |
| 6,072,844 A | * | 6/2000 | Inoue et al. | 375/345 |
| 6,173,257 B1 | * | 1/2001 | Gao | 704/220 |

OTHER PUBLICATIONS

Marcellin et al., Predictive trellis coded quantization of speech, IEEE Transactions on Acoustics, Speech and Signal Processing, Jan. 1990, vol. 38, Issue 1, pp. 46–55.*

Gersho et al., 15.4 Predictive Trellis Encoders, Vector Quantization and Signal Compression, 1192, pp. 573–574.*

International Telecommunication Union (ITU–T) Reccomendation G.728—Annex G, ITU–T Study Group (1993–1996), pp. 1–64.

Isaac Shapira, ITU–T Rec. G. 728, "Variable Bit–Rate operation of LD–CELP mainly for VoiceBand–Data. applications in DCME", Feb. 08, 2000, pp. 1–39.

* cited by examiner

*Primary Examiner*—Marsha D. Banks-Harold
*Assistant Examiner*—Susan McFadden
(74) *Attorney, Agent, or Firm*—Nath & Associates PLLC; Harold L. Novick

(57) ABSTRACT

A method and system for reducing prediction error impulses using a gain average calculator, an impulse detector, a signal classifier decision means and a gain compensator wherein the compensated scaling of a quantizer is determined in a process of encoding/decoding a VBD type transmission by using a vectorial linear non-adaptive predicting type algorithm.

7 Claims, 2 Drawing Sheets

METHOD AND SYSTEM FOR DETERMINING GAIN SCALING COMPENSATION FOR QUANTIZATION

FIELD OF THE INVENTION

The present invention relates to telecommunication systems in general, and in particular to the transmission of compressed signals in telecommunications systems.

BACKGROUND OF THE INVENTION

In recent years, various techniques are being implemented in order to save on required bandwidth, techniques which achieve toll-quality or near toll-quality speech while using compressed telecommunication transmissions. These techniques typically involve the use of coding algorithms that allow reducing the bandwidth requirement of 64 kb/s for non-compressed transmissions. One such example is the LD-CELP algorithm that enables reducing the bandwidth requirement to 16 kb/s. Naturally, in order to use such coding algorithms, both ends of the transmission path must be provided with the ability to code and decode the transmissions. One solution for this requirement is using single proprietary equipment at both ends of and along the transmission path. Another possible solution is the implementation of international standards that allow compatibility of different types of equipment located along a transmission path.

The international standard for the coding algorithm LD-CELP was published on March 1995 as International Telecommunication Union (ITU-T) Recommendation G.728. However, it was found that this Recommendation contained several drawbacks. Among these drawbacks was the handling of transmissions at variable bit rate (referred to hereinafter as "VBR"). This problem was particularly noticed when G.728 Recommendation was used in voice-band data applications.

In its contribution to the ITU-T of Mar. 17, 1997, ECI Telecom Ltd. suggested a solution disclosed in Annex J of ITU-T Recommendation G. 728. The contribution, entitled "Variable Bit-Rate algorithm, mainly for the Voiceband data applications of LD-CELP ITU-T Rec. G. 728 in DCME" is hereby incorporated by reference. This publication will be referred to hereinafter as "40 kbps algorithm".

In this contribution, a solution for VBR and particularly for voice-band data (to be referred to hereinafter as "VBD") application, was described. The contribution provided information for the implementation of a codec that complies with the LD-CELP algorithm, as well as modification to Annex G of Rec. G 728, "16 kbit/s fixed point specification", so as to enable a mode-switch on a fixed point arithmetic device.

The codec described in the 40 kbps algorithm basically uses a transmission rate of 40 kbit/s. The algorithmic delay is 5-samples long, totaling 0.625 msec, and the codec can perform a mode-switch every "adaptation-cycle" (2.5 msec).

The suggested 40 kbps algorithm, was intended mainly to solve problems in the transmission of compressed VBD for applications such as DCME, and was suggested to replace the 40 kbps ADPCM mode (ITU-T Rec.—G.726) in DCME systems where LD-CELP algorithm is incorporated. Among the features provided by this algorithm is the soft transition to and from the LD-CELP algorithm, and the maintaining of toll-quality or near toll-quality of speech.

The adaptation cycle used for the speech mode in the 40 kbps algorithm is essentially provided by G. 728 Recommendation. Therefore, when reverting to speech mode type of operation, the LD-CELP mode specified in Recommendation G.728 will be applied rather than the 40 kbps algorithm.

The main modification of a codec operating in accordance with the 40 kpbs algorithm is the implementation of the Trellis Coded Quantization (referred to hereinafter as "TCQ") approach, described in IEEE Transactions on Communications Vol. 38, No. 1, (1990) which is hereby incorporated by reference. This TCQ approach replaces the analysis-by-synthesis approach to codebook search of ITU-T Rec. G. 728, in the VBD mode.

Still, in the 40 kbps algorithm suggested, no solution was provided to the problem of how to avoid reaching a saturation state when an impulse occurs in the prediction error, e.g. when having a sudden substantial change in the energy level of the prediction error. This problem results in generating a high level of noise at the output of the decoder, and is known to be a cause for discrepancies between the transmitting and the receiving ends of the transmission path.

U.S. Pat. No. 4,677,423 recognizes a somewhat similar problem associated with another type of algorithm, the ADPCM algorithm, and discloses a solution to that problem. The mechanism described in U.S. Pat. No. 4,677,423 is one for overcoming the problem associated with transitions in partial band energy signals, by locking and unlocking the adaptation speed. The adaptation speed is locked in cases of very slow speed of adaptation, while the unlocked mode is used when high speed of adaptation is required. Unfortunately, since this solution is not fast enough for systems having coding algorithms where the predictor is not an adaptive one, e.g. based on Linear Prediction (referred to hereinafter as LP) analysis, a different solution is required. A number of problems render the solution described in U.S. Pat. No. 4,677,423 inefficient when trying to avoid saturation in systems incorporating linear predictors, when an impulse occurs in the prediction error. Some of these problems are: the '423 solution is based on fact that each sample should be handled individually, whereas in linear predictors, a vector comprising a number of samples is used rather than single samples as suggested in the '423 solution, a difference which renders the '423 solution not fast enough to be applied in linear predictors systems. Another basic difference is, that the-errors handles by the '423 patent are logarithmic errors which are not likely to saturate the quantizer as fast as linear errors might. Therefore a different solution is required, one that can provide an answer to systems where linear predictors are incorporated.

SUMMARY OF THE INVENTION

It is therefore an object of the present invention to provide a method for determining the compensated scaling of a quantizer in a coder using a vectorial linear non-adaptive predicting algorithm, a method that overcomes the drawbacks of the prior art solutions described above.

It is another object of the present invention to provide a digital communication apparatus and system enabling to overcome problems caused by impulses occurring in the prediction error.

Further objects and features of the invention will become apparent from the following description and the accompanying drawings.

In accordance with the present invention there is provided a method for determining the compensated scaling of a quantizer in a process of encoding/decoding a VBD type transmission by using a vectorial linear non-adaptive predicting type algorithm.

The term "VBD" as will be referred hereinafter, is used to denote digital signals modulated for transmission in the voice band frequency (up to 4 KHz), e.g. modem signals, DTMF signals, or any other such narrow band type of signals.

The method provided by the present invention, preferably comprises the steps of:

i. providing a digital sample vector in a coded form;

ii. calculating LP coefficients for predicting said digital sample vector and deriving a linear prediction error vector therefrom;

iii. calculating the gain of said linear prediction error vector;

iv. calculating the scaling of the quantizer from said gain;

v. calculating an average value of said gain corresponding to said digital sample vector, based on preceding digital samples;

vi. calculating the difference between said gain and said average value;

vii. determining whether a gain compensation is required for an impulse in the prediction error of said digital sample vector, based on:

(a) comparing said difference with a first pre-defined threshold value, and (b) comparing the differences between the gains associated with a pre-defined number of most recent digital sample vector provided and their corresponding average values and a second pre-defined threshold;

viii. in the case that the determination in step (vii) is that a gain compensation is required, determining the compensation required for the impulse in the prediction error of said digital sample vector;

ix. combining the scaling of the quantizer as obtained by step (v) with the gain compensation determined in step (viii) to obtain the compensated scaling of the quantizer.

An example of such a linear non-adaptive predicting algorithm is an algorithm of the type all poles modeling.

The determination whether a signal can be qualified as a steady signal, is done by comparing the differences existing between the gains associated with a pre-defined number of preceding digital sample vectors and the average values associated therewith, with the second pre-defined threshold. If these differences do not exceed that second pre-defined threshold, the signal may be qualified as a steady signal.

According to a preferred embodiment of the invention, the method described further comprises a step of calculating the value of a pre-defined function, which function is based on the calculated LP coefficients associated with the digital sample vector. The value of the pre-defined function thus obtained may be used in determining the required gain compensation. According to this embodiment, this can be done for example, by setting a constrain that unless the calculated value is higher than that of a pre-defined value, no gain compensation will be carried out. Another possible example is by applying a factor on the gain compensation that depends on the difference existing between the calculated value and that of the pre-defined value.

An example of such a pre-defined function according to this embodiment is a function that is equal to $$\frac{\mathrm{ABS}(A(1))}{\sum_{i=1}^{11} \mathrm{ABS}(A[i])}$$

where A[i] are the LP coefficients.

Similarly, as can be appreciated by any person skilled in the art, other gain compensation decision mechanisms can also be used and their results be incorporated in the final decision upon the actual compensation to be carried out.

According to yet another embodiment of the present invention, a peak threshold value is pre-defined, and the calculated value of the difference as calculated in step (v) of the above method, is compared with that peak threshold. This embodiment enables among others, extending a first pre-defined period of time during which the gain is compensated while its value does not exceed that peak threshold. The gain compensation period can be extended for example until either the peak is reduced below the level of that peak threshold, or to a longer, pre-defined period of time.

According to still another preferred embodiment of the present invention, the linear prediction error vector is derived by performing a Trellis code quantization on the prediction error vector, and selecting a preferred quantized linear prediction error vector from among a number of quantized linear prediction error vectors calculated. More preferably, such selection is made by choosing the linear prediction error vector that has the minimal prediction error.

According to a further embodiment of the present invention, the determination of the gain compensation required as set at step (viii) is subjected to a limiting threshold to prevent from reaching over-compensation of the gain.

By another aspect of the present invention, there is provided digital telecommunication station operative in a digital telecommunication system, and comprises:

input interface adapted to receive a voiceband data signal and operate thereon;

processing means adapted to calculate:

LP coefficients for predicting said digital sample vector and deriving a linear prediction error vector therefrom;

the gain of said linear prediction error vector;

the scaling of the quantizer based on said gain;

an average value of said gain corresponding to said digital sample vector, based on preceding digital samples;

the difference between said gain and said average value;

first determination means for determining whether a gain compensation for the impulse in the prediction error of said digital sample vector is required, based on:

a. comparing said difference with a first pre-defined threshold value, and b. comparing the differences between the gains associated with a pre-defined number of most recent digital sample vectors save that of said digital sample vector provided and their corresponding average values and a second pre-defined threshold, second determination means adapted to determine the gain compensation required to compensate for the impulse in the prediction error of said digital sample vector if the determination made by the first determination means is affirmative;

means for combining the scaling of the quantizer with the gain compensation determined by said second determination means; and output interface adapted to transmit a voiceband data signal.

As would be appreciated by a person skilled in the art, the device described above may comprise further features that are known in the art per se, and should thus be understood as being encompassed by the present invention.

The term "telecommunication network", as will be used hereinafter, should be understood to encompass the various types of networks known in the art, such as TDM, synchronous and asynchronous transfer networks, IP networks, IP frame relaying networks and any other applicable communication networks.

The term "telecommunication station" is used herein to describe a combination of at least one pair of encoding/decoding devices, one of which is used for converting, when required, signals received to a new coded form, while the other is used as its corresponding decoder, converting signals received in this new coded form to essentially their pre-encoder form. Such two devices may either be included within one apparatus or be separated from each other.

According to still a further embodiment of the invention there is provided a telecommunication apparatus operative in a digital telecommunication system and adapted to produce temporal change in quantization gain in a process of encoding/decoding transmission of the VBD type, comprising the following:

i. gain average calculator;

ii. impulse detector;

iii. signal classifier;

iv. decision means; and

V. gain compensator.

According to another preferred embodiment, the average calculator is operative to calculate the average of the gain estimation by using the most recent vector gain value, and the difference, $G_{diff}$, between said most recent vector gain value and said average of the gain compensation. More preferably, the difference $G_{diff}$ is received and compared with a pre-determined first threshold, by the impulse detector which is operative to detect sudden changes in the gain after a predetermined period of time.

According to yet another preferred embodiment of the present invention the signal classifier is adapted to detect pre-defined VBD transmissions, and more preferably, the decision means is adapted to receive the output of the impulse detector and the signal classifier, and to activate the gain compensator accordingly.

By still another preferred embodiment, the gain compensator is operative to increase the gain for a pre-defined period of time.

According to another aspect of the invention there is provided a digital communication system for interconnecting a plurality of telecommunication trunks via a transmission path, comprising:

first transmission means at at least a first end of the transmission network for transmitting digital signals;

at least one pair of telecommunication stations of the type specified, and receiving means at at least a second end of the transmission network.

DETAILED DESCRIPTION OF THE INVENTION

Figure 1:
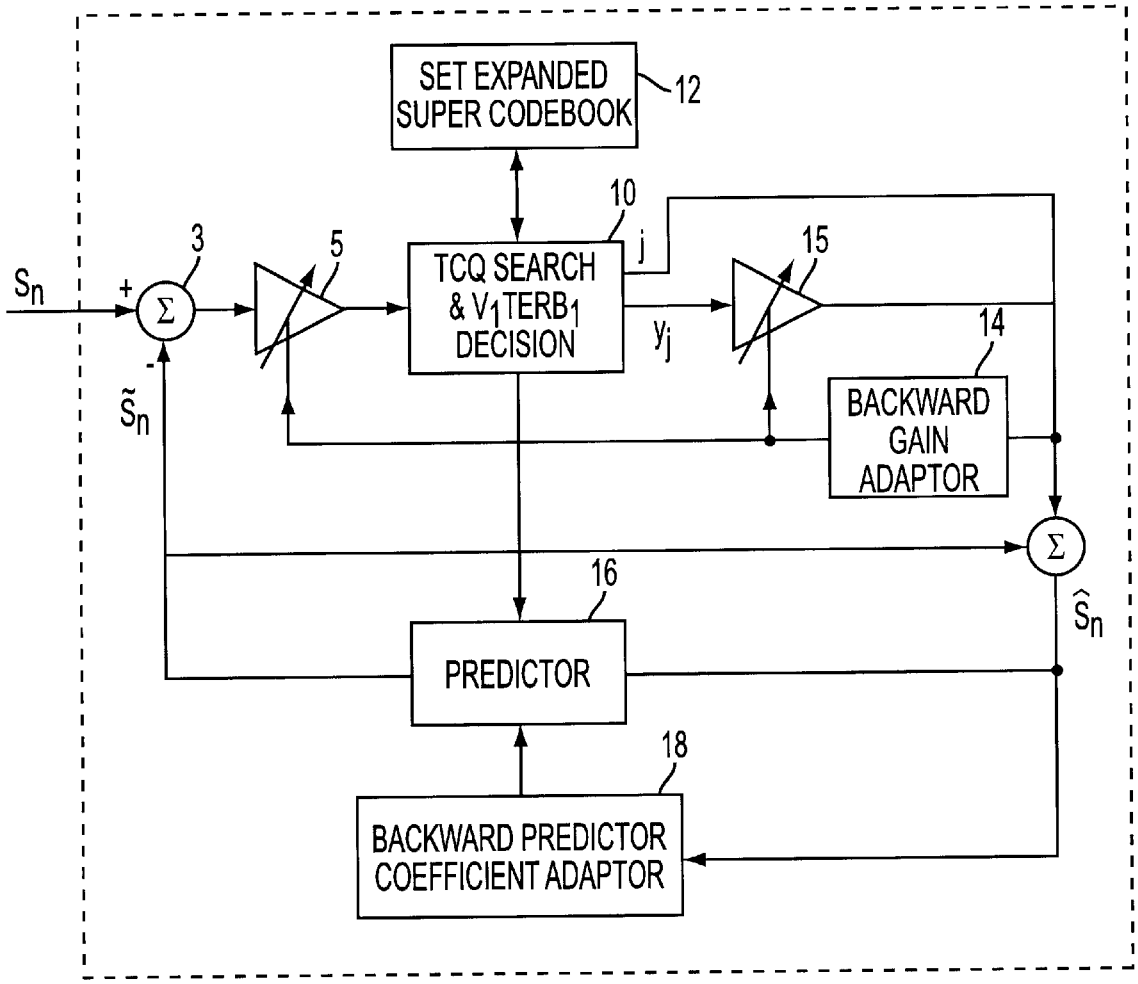
FIG. 1 illustrates a schematic representation of a coder incorporating the method of handling VBD signals according to the present invention.

The schematic partial structure of a coder 1 of the present invention is presented in FIG. 1.

Signal Sn is introduced into a summing device 3 together with the predicted value thereof S'n. The difference is passed through a pre-amplifier 5 to a TCQ Search. & Viterbi decision block, 10. The information received by this block, following the processing of the difference together with the relevant input derived from block 12, a set of expanded super codebook, is passed through gain scaling device 15 and to predictor 16. All the operations required by the TCQ (Trellis Coded Quantization) algorithm are carried out in the set up demonstrated in this Figure, by block 10. Such operations may include for example, management of the Trellis survivors and the specified reproduction values, calculation and comparison of matrices, and determination of the Viterbi decisions. The Viterbi decisions are taken as known in the art according to the following procedure. Each node of a given set of nodes comprises a number of legitimate branches. At each step of the procedure a limited number of these branches is selected, where the selected branches are those that will lead to a smaller error. After repeating this procedure for a number of samples, the path connecting the branches that would lead to the minimal overall error is selected. In the present configuration, block 10 also releases 5 channel indices designated in FIG. 1 as j, referencing the best survivor Yj for the 5 source samples by the Viterbi algorithm.

Figure 2:
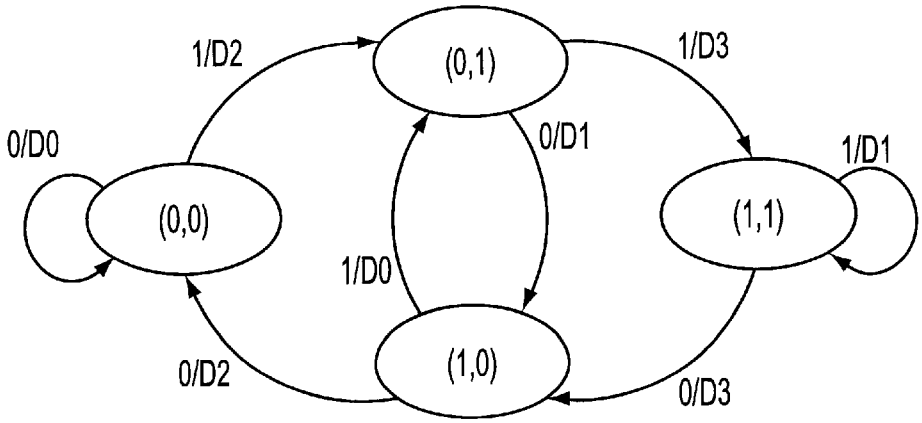
FIG. 2 describes schematically a typical state machine for generating a Trellis diagram.
Figure 3:
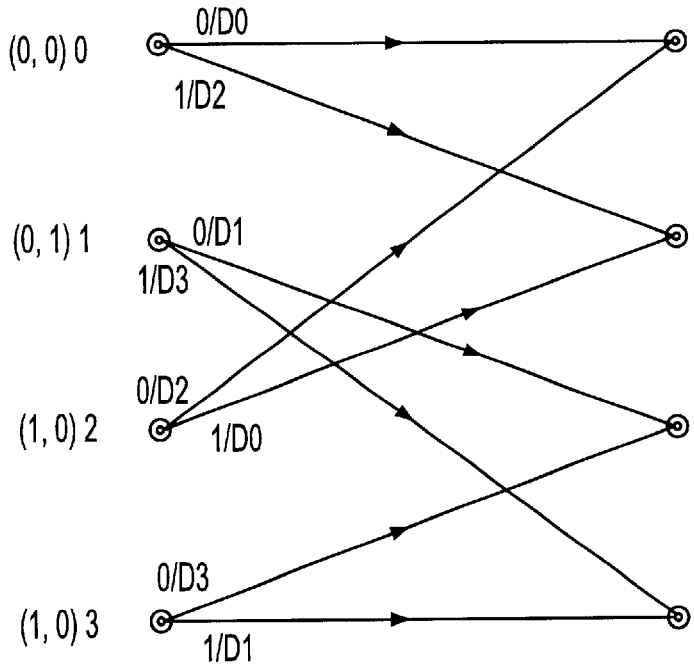
FIG. 3 presents an example of a Trellis diagram generated by a state machine demonstrated in FIG. 2.

A typical state machine that generates the Trellis diagram and the Trellis diagram itself, are illustrated schematically in FIGS. 2 and 3.

Section 7.1 of the "40 kbps algorithm" provides the allowed path to the previous nodes through the Trellis lattice, for every node. For example, the allowed previous nodes for the first node (s[0]) are node 0 under branch 0 (b[0]) and node 2 under branch 1 (b[1]).

Section 7.2 of the "40 kbps algorithm" provides the allowed path to the next nodes through the Trellis lattice, for every node. For example, the allowed next nodes for the first node (s[0]) are node 0 under branch 0 (b[0]) and node 2 under branch 1 (b[1]).

Section 7.3 of the "40 kbps algorithm" provides the quantization subset {D0, D1, D2, D3} associated with every Trellis path. For example, the transition from s[0] to s[0] is associated with subset D0. Transition from s[0] to s[1] is associated with subset D2, and transitions to s[2] and s[3] are not allowed and are, therefore, marked with X.

Section 7.4 of the "40 kbps algorithm" provides the index bit that labels each transition, and identifies the two branches that emanate from each node. For example, transition from s[0] to s[0] is associated with 0. Transition from s[0] to s[1] is associated with 1 (note that bit 5 is used, and 0×10 is 10h in C), and transitions to s[2] and s[3] are not allowed, and are therefore marked with X.

As previously mentioned, block 12 is the Super Codebook which is a set-expanded scalar Lloyd-Max quantizer. The 64 output levels are partitioned into four subsets, starting with the most negative point and proceeding towards the most positive point, labeling consecutive points as {D0, D1, D2, D3, . . . D0, D1, D2, D3}. The quantization levels are given in section 7.6 of the "40 kbps algorithm" and the interval limits are given in section 7.5 of the "40 kbps algorithm". The levels that belong to subset D0 are shown in the column marked s[0]. D1 levels are shown below s[1], . . . , and D3 are shown below s[3].

When VBD signals are handled by the backward gain adapter 14, there are several differences in accordance with the present invention in its operation as compared with the way speech signals are handled in accordance with G 728 ITU-T standard. The major differences are:

1) In the VBD mode, the RMS value of the codebook output values is calculated over a sequence of output levels (quantized residuals) that are specified by the survivor path. The RMS is calculated over a sequence of 8 samples. However, unlike the disclosure provided in Annex G of G.728 where pre-computed tables store the log RMS, in the VBD mode it is necessary to calculate the logarithmic value of the RMS. Eq. (1) provides the logarithmic approximation. The coefficients $d_0$, $d_1$, $d_2$, $d_3$, $d_4$ are provided in section 8 of the "40 kbps algorithm" and the detailed description of the logarithmic calculator is provided in section 4.12 therein.

$$2*\log_{10}(x)=d_0*(x-1)+d_1*(x-1)^2+d_2*(x-1)^3+d_3*(x-1)^4+d_4*(x-1)^5 \quad \text{Eq. (1):}$$

where $1 \leqq x<2$

For values of x other than those specified above, a normalization procedure is carried out. Such a procedure is described in block #J.16 of the "40 kbps algorithm"publication.

The log RMS value replaces the output of the shape and gain codebook, log-gain tables blocks #G.93 and #G.94 (the last two terms in equation G-14).

2) A smoothing filter may be introduced in the log gain loop, to reduce the steady-state oscillation for signals with stationary variance, such as voice-band data waveform. To overcome both speech and data signals, a Dynamic Locking Quantizer ("DLQ") algorithm generates a variable speed adaptation. A DLQ algorithm similar to that described in ITU-T Rec. G. 726 may be used.

The input to the processor using the DLQ algorithm, is the offset removed log-gain d(n). This input is averaged by the weighting filter (section 4.13 of the "40 kbps algorithm" block #J.14) to produce the locked gain $G_L$.

The quantizer is in a completely locked state if $a_1=0$, and in completely unlocked state if $a_1=1$. $a_1$ is calculated by comparing the long-term and the short-term energy of the quantized residuals ET(n) (section 4.10, block #J.12 of the "40 kbps algorithm"). The comparison characterizes the constancy of the variance of quantized residuals.

$$G=G_U*\alpha_1+G_L*(1-\alpha_1) \quad \text{Eq. (2):}$$

3) Prediction error impulses might cause the saturation of the quantizer. In order to prevent such a situation, a temporal change in quantization gain is carried out in accordance with the method provided by the present invention.

Naturally, a preferred way of performing the average calculation for carrying out the method of the present invention, is by assigning more weight to the most recent gain values in the calculation.

Figure 4:
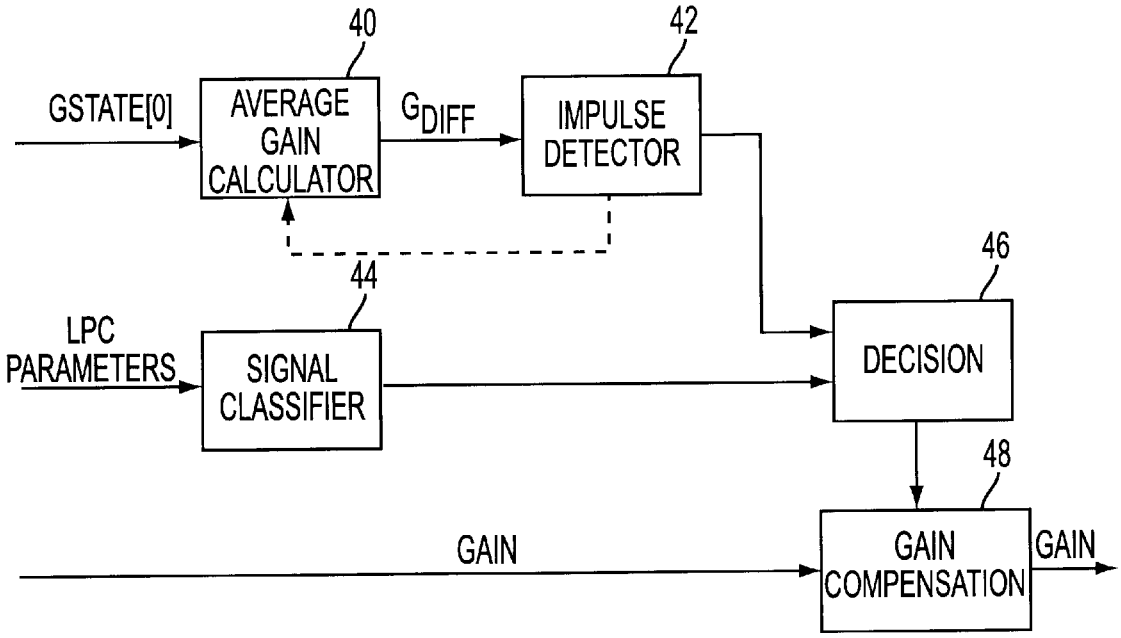
FIG. 4 illustrates schematically a method of carrying out a temporal change in the quantization gain in accordance with the present invention.

FIG. 4 illustrates schematically a method of carrying out the temporal change in the quantization gain. In accordance with this method, the following steps are taken:

a. Calculating the gain average: A smoothing filter 40 calculates the average of the gain estimation, Gave, using the most recent vector gain value, GSTATE [0]. Preferably, the calculated average is a weighted average, giving higher weight to recent values than to past values. Equation 3 presents an optional way of calculating such an average. The difference between GSTATE [0] and $G_{ave}$, designated as $G_{diff}$, is then calculated and passed to an Impulse Detection block 42.

$$G_{ave}=G_{const}*G_{ave}+(1-G_{const})*GSTATE[0] \quad \text{Eq. (3):}$$

b. Impulse Detection block 42: The function of this block is essentially the detection of sudden changes in the gain following a predetermined period of time wherein impulses were not detected. In order to accomplish that, $G_{diff}$ is compared with a second fixed pre-defined threshold. If the value of $G_{diff}$ were less than that of the second pre-defined threshold for a period exceeding a predefined period of time, then the signal would be treated as a "steady" signal. A linear prediction error impulse is detected when the value of $G_{diff}$ exceeds that of a first pre-defined threshold while the preceding signal was determined to be a "steady" signal. According to a preferred embodiment of the present invention, the first pre-defined threshold is equal to the second pre-defined threshold.

c. Signal Classifier During certain VBD transmission, error impulses are more likely to happen. Thus, upon their detection, the parameters of the gain compensation can be maximized. In signal classifier block 44 these transmissions are detected e.g. by using the LP coefficients, and the classification is forwarded to the decision block 46.

d. Decision block 46: The decision block 46 receives both the output of the signal classifier block 44 and that of the impulse detection block 42. Based on these outputs, a decision is taken whether a compensation is required, and how will the gain compensation parameters described in the following paragraph, be affected when activating the gain compensation block 48.

e. Gain Compensation block 48: The major task carried by block 48, is to define the gain compensation required, and allow the increase in the gain factor for a first pre-determined period of time. This first pre-defined period of time may, in accordance with another embodiment of the invention, be changed. According to this other embodiment, a third pre-defined threshold is set for the gain peak threshold. Once this third pre-defined threshold is reached, an extended period of time is used for the gain compensation, where this period can be re-defined as a second pre-defined period of time. The use of such an embodiment allows extending the period of gain compensation in case the impulse change is relatively very high. As will be appreciated by a person skilled in the art, many variations and modifications which eventually achieve the same task can in fact be made on the above described method, and are encompassed by the present invention. For example, instead of extending the period of compensation, the level of the gain compensation can be changed so as to achieve the required effect. Also, in case a limiter is used to limit the level of compensation, the value of that limiter may be adapted to provide a better way to carry out the required gain compensation.

The following is the description of the remaining blocks 14 (the backward gain adapter), 16 (the predictor) and 18 (the backward prediction coefficient adapter) shown in FIG. 1.

Predictor 16 is a shorter version of the G. 728 synthesis filter (block #G.22). The order of the polynomial comprising the LP coefficient 10 taps, instead of the usual 50 taps used in the synthesis filter. The prediction is based on the survivor path (section 4.4, block #J.7 of the "40 kbps algorithm"), in the following manner: at time n, a prediction of the current sample is formed for each node (section 4.5, block #J.8 of the "40 kbps algorithm"), using the sequence of reproductions specified by the survivor selected at time n−1. Using this method, only a one-step scalar prediction is performed, and the prediction does not have to be extended far into the future. This makes the prediction more "localized" than in many other predictive VQ schemes.

The backward prediction coefficient adapter, 18, is similar to the backward synthesis filter adapter (block #G.23). the major differences are the following:

Only 10 LPC parameters are calculated. The hybrid windowing module (block #G.49) constantly calculates 51 auto-correlation coefficients, enhancing the performance of data-to-voice transitions.

The bandwidth expansion factor of the synthesis filter is now 240/256. The bandwidth expansion coefficients are provided in section 9 of the "40 kbps algorithm".

EXAMPLE

In order to evaluate the performance of the method provided by the present invention, the following set of tests was carried out. A VBD transmission of the V.23 type, in character mode, was evaluated using the G.728 40 kbps algorithm. In the evaluation, the transmitted characters were compared with those received, and the number of discrepancies found out of the total number of characters transmitted, was calculated. This ratio was defined as the average error.

When applying the G.728 including the "40 kbps algorithm" amendment, the average error was found to be about 33%.

In similar tests, the method provided by the present invention was evaluated. The values of the first and second pre-defined thresholds were pre-set to be equal to 1800. Once an impulse in the prediction gain was found to exceed the value of 1800, the gain compensation mechanism was activated provided that the preceding 80 digital sample vectors each comprising 5 samples where every sample was 125 $\mu$sec long were determined as being signals of the "steady" type. A dramatic decrease in the average error defined above was observed, as it dropped to about 0.05%.

It is to be understood that the above description serves only for demonstrating certain embodiments of the invention. Numerous other ways of carrying out the invention provided may be devised by a person skilled in the art without departing from the scope of the invention, and are thus encompassed by the present invention.

What is claimed is:

1. A method for determining gain scaling compensation for a quantizer in a process of encoding/decoding a Voice-Band Data (VBD) type of transmission, by using a vectorial linear non-adaptive predicting type algorithm, the method comprising the steps of:

i. providing a digital sample vector in a coded form;

ii. calculating LP coefficients for predicting said digital sample vector and deriving a linear prediction error vector therefrom;

iii. calculating the gain of said linear prediction error vector;

iv. calculating the scaling of the quantizer from said gain;

v. calculating an average value of said gain corresponding to said digital sample vector, based on preceding digital samples;

vi. calculating the difference between said gain and said average value;

vii. determining whether a gain compensation is required for an impulse in the prediction error of said digital sample vector, based on:

(a) comparing said difference with a first pre-defined threshold value, (b) comparing the differences between the gains associated with a predefined number of most recent digital sample vector provided and their corresponding average values and a second pre-defined threshold, and (c) calculating the value of a predefined function that is equal to $$\frac{\mathrm{ABS}(A(1))}{\sum_{i=1}^{11} \mathrm{ABS}(A[i])}$$

where A are the LP coefficients associated with said digital sample vector;

viii. in the case that the determination in step (vii) is that a gain compensation is required, determining the compensation required for the impulse in the prediction error of said digital sample vector; and ix. combining the scaling of the quantizer as obtained by step (v) with the gain compensation determined in step (viii) to obtain the compensated scaling of the quantizer.

2. A method for determining gain scaling compensation for a quantizer in a process of encoding/decoding a Voice Band Data (VBD) type of transmission, by using a vectorial linear non-adaptive predicting type algorithm, the method comprising the steps of:

i. providing a digital sample vector in a coded form;

ii. calculating LP coefficients for predicting said digital sample vector and deriving a linear prediction error vector therefrom;

iii. calculating the gain of said linear prediction error vector;

iv. calculating the scaling of the quantizer from said gain;

v. calculating an average value of said gain corresponding to said digital sample vector, based on preceding digital samples;

vi. calculating the difference between said gain and said average value;

vii. determining whether a gain compensation is required for an impulse in the prediction error of said digital sample vector, based on:

(a) comparing said difference with a first pre-defined threshold value, (b) comparing the differences between the gains associated with a pre-defined number of most recent digital sample vector provided and their corresponding average values and a second pre-defined threshold, and (c) comparing the difference existing between said gain and said average value with a pre-defined peak threshold;

viii. in the case that the determination in step (vii) is that a gain compensation is required, determining the compensation required for the impulse in the prediction error of said digital sample vector;

ix. combining the scaling of the quantizer as obtained by step (v) with the gain compensation determined in step (viii) to obtain the compensated scaling of the quantizer.

3. A method according to claim 2, wherein a first pre-defined period of time during which the gain is compensated is extended until the gain's value is reduced to below the level of said pre-defined peak threshold.

4. A method according to claim 2, wherein step iii comprises the steps of:

performing a Trellis code quantization of said linear prediction error vector and producing a number of quantized linear prediction error vectors thereof;

selecting a preferred quantized linear prediction error vector from among said number of quantized linear prediction error vectors; and calculating the gain of said preferred quantized linear prediction error vector.

5. A method according to claim 4, wherein the selection is made by choosing the linear prediction error vector that has the minimal prediction error.

6. A method for determining gain scaling compensation for a quantizer in a process of encoding/decoding a Voice Band Data (VBD) type of transmission, by using a vectorial linear non-adaptive predicting type algorithm, the method comprising the steps of:

i. providing a digital sample vector in a coded form;

ii. calculating LP coefficients for predicting said digital sample vector and deriving a linear prediction error vector therefrom;

iii. calculating the gain of said linear prediction error vector;

iv. calculating the scaling of the quantizer from said gain;

v. calculating an average value of said gain corresponding to said digital sample vector, based on preceding digital samples;

vi. calculating the difference between said gain and said average value;

vii. determining whether a gain compensation is required for an impulse in the prediction error of said digital sample vector, based on;

(a) comparing said difference with a first pre-defined threshold value; and (b) comparing the differences between the gains associated with a pre-defined number of most recent digital sample vector provided and their corresponding average values and a second pre-defined threshold:

viii. in the case that the determination in step (vii) is that a gain compensation is required, determining the compensation required for the impulse in the prediction error of said digital sample vector;

ix. combining the scaling of the quantizer as obtained by step (v) with the gain compensation determined in step (viii) to obtain the compensated scaling of the quantizer;

wherein the determination of the gain compensation required as set forth in step (viii) is subjected to a limiting threshold to prevent from reaching over-compensation of the gain.

7. A digital telecommunication station operative in a digital telecommunication system, and comprises:

input interface adapted to receive a voice band data signal and operate thereon;

processing means adapted to calculate:

LP coefficients for predicting said digital sample vector and deriving a linear prediction error vector therefrom;

the gain of said linear prediction error vector;

the scaling for the quantizer based on said gain;

an average value of said gain corresponding to said digital sample vector, based on preceding digital samples; and the difference between said gain and said average value;

first determination means for determining whether a gain compensation for the impulse in the prediction error of said digital sample vector is required, based on:

i. comparing said difference with a first pre-defined threshold value, and ii. comparing the differences between the gains associated with a pre-defined number of most recent digital sample vectors save that of said digital sample vector provided and their corresponding average values and a second pre-defined threshold;

second determination means adapted to determine the gain compensation required to compensate for the impulse in the prediction error of said digital sample vector if the determination made by the first determination means is affirmative;

means for combining the scaling of the quantizer with the gain compensation determined by said second determination means;

a quantizer operative to receive a linear prediction error vector and quantize it into digital codes; and output interface adapted to transmit a voiceband signal.

* * * * *